US006893557B2

(12) United States Patent
Harris-Griffin et al.

(10) Patent No.: US 6,893,557 B2
(45) Date of Patent: May 17, 2005

(54) SKIMMER BASKET WEIGHT

(75) Inventors: Kimberly Day Harris-Griffin, Palm Beach Gardens, FL (US); Roger R. Griffin, Palm Beach Gardens, FL (US)

(73) Assignee: Kimberly D. Harris-Griffin, Palm Beach Gardens, FL (US)

( * ) Notice: Subject to any disclaimer, the term of this patent is extended or adjusted under 35 U.S.C. 154(b) by 0 days.

(21) Appl. No.: 10/601,041

(22) Filed: Jun. 20, 2003

(65) Prior Publication Data

US 2004/0031738 A1 Feb. 19, 2004

Related U.S. Application Data

(60) Provisional application No. 60/390,873, filed on Jun. 21, 2002.

(51) Int. Cl.[7] ..... E04H 4/16
(52) U.S. Cl. ..... 210/169; 210/416.2
(58) Field of Search ..... 210/169, 232, 210/416.1, 416.2, 448

(56) References Cited

U.S. PATENT DOCUMENTS 4,268,390 A * 5/1981 Cunningham ..... 210/232
4,879,772 A * 11/1989 Meloney, Jr. ..... 4/506
5,672,271 A * 9/1997 Dye ..... 210/169
6,592,756 B1 * 7/2003 Felix et al. ..... 210/169

* cited by examiner

*Primary Examiner*—Fred G. Prince

(57) ABSTRACT

A skimmer basket weight is provided, which is made of a heavy material having a density greater than 1.0 g/cm$^3$, coated with a water proof coating, and is configured to have a circular outer periphery with a hollow opening for allowing water flowing through. The circular outer periphery has a diameter substantially matching an inner diameter of a bottom of a skimmer basket. When in use, one places the skimmer basket weight inside the skimmer basket, and affixes the skimmer basket weight on top of the bottom of the skimmer basket. The weight prevents the skimmer basket from floating and tipping over inside the skimmer well. Also disclosed is a skimmer basket assembly which includes a skimmer basket, the weight and a fastening means.

17 Claims, 3 Drawing Sheets

SKIMMER BASKET WEIGHT

REFERENCE TO RELATED APPLICATION

This application claims priority to co-pending Provisional Application Ser. No. 60/390,873, filed Jun. 21, 2002, which is herein incorporated by reference in its entirety.

FIELD OF THE INVENTION

The present invention relates to in general a device for preventing skimmer basket from floating and tipping over inside skimmer well. More particularly, the present invention relates to a skimmer basket weight for retaining the position of the skimmer basket.

BACKGROUND OF THE INVENTION

Most modern swimming pools utilize circulation and filtration systems to clean the mater therein. One component of the filtration is a "skimmer" which is generally designed to "skim" debris from the surface of the pool. A skimmer is a relatively simple structure which involves a skimmer well positioned adjacent to the pool with the top of the well lying slightly below the normal water level of the pool. There is then a waterway between the skimmer well wall and the pool wall which allows the upper surface of the pool water to enter the area above the top of the well.

At the bottom of the skimmer well is an opening through which water in the skimmer well is drawn by a vacuum pump through a filtering system, then is returned to the pool after filtration. In normal operation, items floating on top of the water are pulled into the skimmer well with the water. To capture these objects and prevent them from going into the pump, or into later finer filters, the skimmer well generally includes a skimmer basket, which is essentially a perforated insert or "strainer" sized to fit into the well. The skimmer basket is made of plastic, which traps leaves or other items which flow into the skimmer well.

Because of the skimmer basket's shape and its usual construction of plastic, the skimmer basket is somewhat buoyant. In operation, the vacuum pump is pulling from the base of the skimmer well, and the skimmer basket is held in place by the vacuum created. Usually, for a private pool one only needs to circulate the pool water for a few hours a day to maintain water quality. When not in circulation, the pump is shut off. Even for a large and public pool, the pump usually is shut off in the night to conserve electricity. In other instances, the pump may be shut off to allow the user to remove a clogged skimmer basket as trying to remove a clogged basket against the vacuum pump's pull can be difficult.

Because of its natural buoyancy, when the pump is shut off the basket can float out of the well. This can lead to numerous problems. For one, debris can get trapped within the well by flowing under the skimmer basket as it is floating. Secondly, the skimmer basket can tip over while floating and deposit its contents back into the pool, defeating the skimmer basket's primary purpose of removing the debris from the pool.

As described above, it is apparent that there is a need for a device which retains the skimmer basket in the skimmer well, and an improved skimmer basket which can self-retain in the skimmer well without floating when the pool pump is off.

SUMMARY OF THE INVENTION

In one embodiment, the present invention provides a skimmer basket weight. The skimmer basket weight comprises a heavy material having a density greater than 1.0 g/cm$^3$, being coated with a water proof coating. The skimmer basket weight is configured to have a circular outer periphery with a hollow opening. The circular outer periphery has a diameter substantially matching an inner diameter of a bottom of a skimmer basket.

In a further embodiment, the present invention provides a skimmer basket assembly, which comprises a skimmer basket, a skimmer basket weight comprising a heavy material having a density greater than 1.0 g/cm$^3$, coated with a water proof coating, said skimmer basket weight having a hollow opening, and a fastening means enabling affixing said skimmer basket weight to said bottom of said skimmer basket.

In another embodiment, the present invention provides a weight containing skimmer basket, which comprises a basket configured for a swimming pool skimmer well and a weight connected to the bottom of the basket. The weight is made of a heavy material having a density greater than 1.0 g/cm$^3$, and coated with a water proof coating.

In a still further embodiment, the present invention provides a method of preventing skimmer basket floating. The method comprises the steps of providing a skimmer basket weight which has a hollow opening; and placing the skimmer basket weight inside the skimmer basket and having the skimmer basket weight laid on top of the bottom of the skimmer basket, with the hollow opening aligned with a center of the skimmer basket. The method further comprises affixing the skimmer basket weight to the skimmer basket. Using the skimmer basket weight of the present invention, the skimmer basket will not float or tip over when the pump is off.

The above features and advantages of the present invention will become apparent from the hereinafter set forth Detailed Description of the Invention and Claims appended herewith.

DETAILED DESCRIPTION OF THE INVENTION

Figure 1:
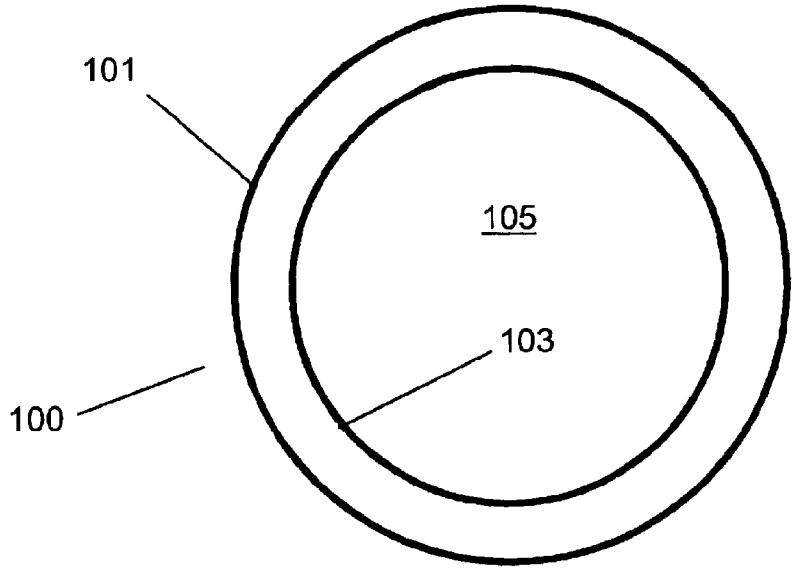
FIG. 1 is a depiction of an embodiment of a skimmer basket weight.

In one embodiment, the present invention provides a skimmer basket weight which can be used to hold the skimmer basket in place in the skimmer well when the pump is turned off to prevent the basket from floating. FIG. 1 illustrates one embodiment of a skimmer basket weight.

The weight (100) is generally of a toroidal or cylindrical shape having an outer surface, or periphery (101) and an inner surface, or periphery (103), the inner surface (103) defining a hollow opening (105) through the width of the weight (100). In another embodiment, the weight (100) can be of any generally tubular and/or hollow shape. That is, the outer surface (while preferably round) and the inner surface (which is also preferably round) may be of any shape. The outer and inner surface may also have different shapes so long as the resulting structure is hollow.

It is preferred that the outer diameter of the weight (100) substantially match with the inner diameter at the bottom of a skimmer basket. In one preferred embodiment, the weight (100) has an outer diameter from about 125 mm to 150 mm, more preferably about 145 mm; and the wall (the area between the outer surface and the inner surface) is from about 18 mm to about 40 mm, more preferably about 30 mm wide; and the inner surface having a diameter from about 90 mm to about 120 mm, more preferably, about 115 mm.

The weight (100) can be constructed of any material or materials known to those of ordinary skill in the art. Preferably, the weight is constructed of a heavy material which has a density greater than 1.0 g/cm$^3$. Suitable examples include concrete, metal, high density plastic, and other suitable materials. The weight is then coated with plastic, rubber, paint or other waterproof materials to prevent the weight from being damaged or degraded by the water in the pool or any of the chemicals therein. In the preferred embodiment, the weight weighs at least ½ pound, more preferably ¾ pound. Additionally, lighter weights may be used in other embodiments.

It is preferred that the weight be sized and shaped so as to be universally useable across a wide variety of different skimmer baskets. In particular, there are numerous manufacturers of skimmer baskets who produce a plethora of different designs. It is preferable that the weight (100) be sized and shaped so as to fit in a plurality of different designs of skimmer baskets.

Figure 2:
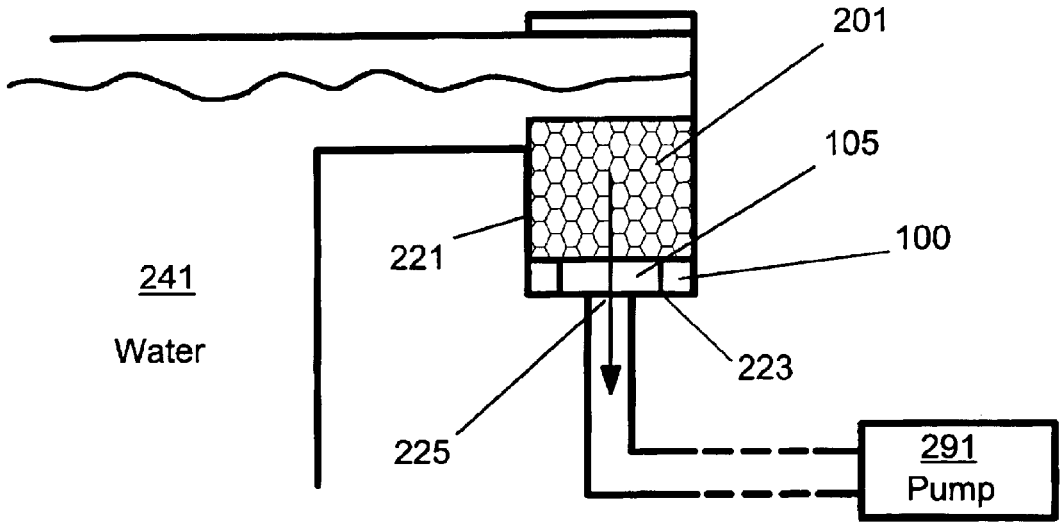
FIG. 2 is a vertical axial cutaway view showing the weight of FIG. 1 in an embodiment of a skimmer basket in one embodiment of a skimmer well.

In operation, the weight is preferably used as shown in FIG. 2. The weight (100) is placed at the bottom of the skimmer basket (201) such that water can flow in a generally vertical manner through the weight. The skimmer basket (201) is then placed back into the skimmer well (221) in the traditional manner. In a more preferred embodiment, the hollow opening (105) is placed above the opening (225) in the base (223) of the skimmer well (221) so that it does not obscure the opening (225) in any way. As shown in FIG. 2, water (241) can flow through the hollow opening (105), through the opening (225) and to the pump (291).

Figure 3:
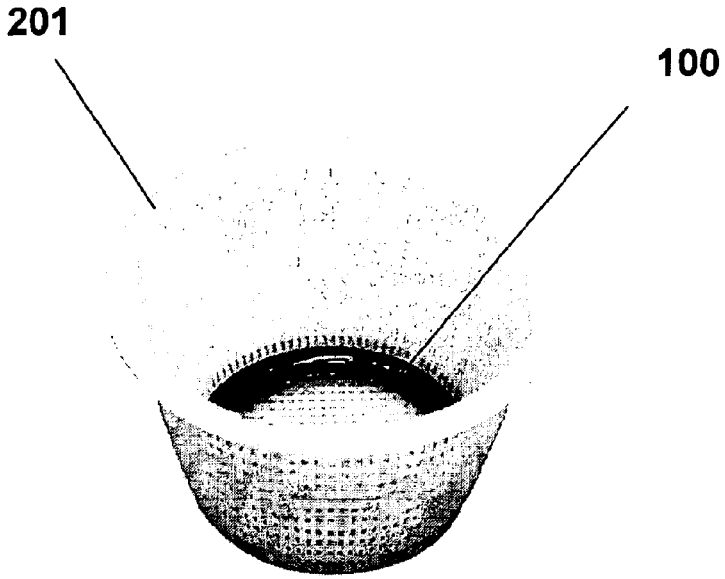
FIG. 3 is perspective view of a skimmer basket weight of one embodiment of the present invention placed in a skimmer basket.
Figure 4:
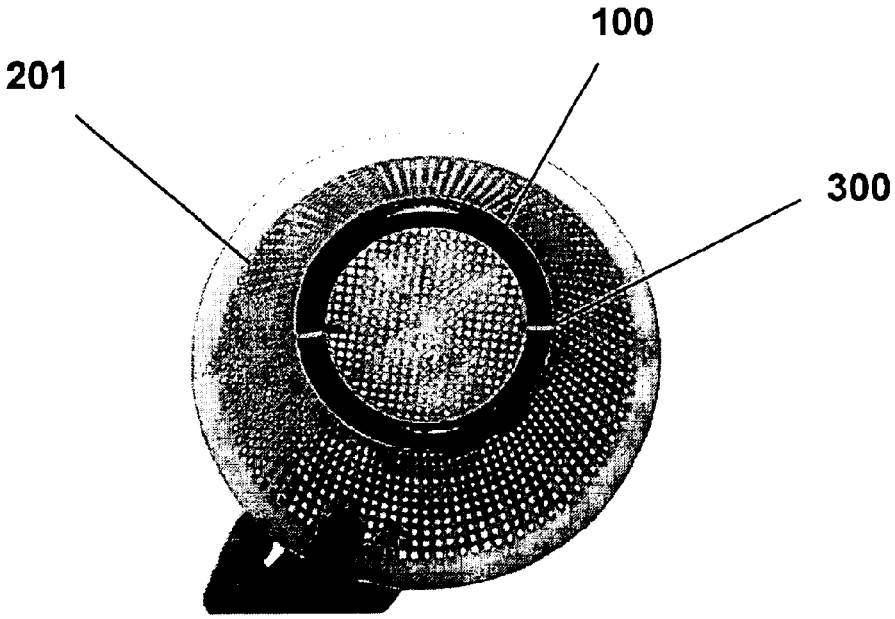
FIG. 4 is a top view of a skimmer basket weight of one embodiment of the present invention, which is affixed to the bottom of a skimmer basket.

FIG. 3 shows a perspective view of a weight (100) positioned at the bottom of a skimmer basket (201). FIG. 4 shows a top view of a weight (100) in a skimmer basket (201), wherein the weight (100) is affixed to the skimmer basket (201) by tie straps. The weight (100) illustrated in FIG. 4 is covered by a plastasil coating.

The weight (100) is generally of limited height so as to not overly interfere with the straining capability of the skimmer basket. Preferably, the height of the weight (100) is from about 10 mm to about 50 mm. More preferably, the height of the weight (100) is about 14 mm. Additionally, the weight can itself be perforated to improve water flow.

In a further embodiment, the weight needs not be a complete hollow shape, instead, the hollow opening (105) can have an access to the outside. In other words, the inner surface and outer surface can be broken. This gives the weight (100) a generally horseshoe type shape.

In another embodiment, the weight may include a handle. The handle could enable the user, when emptying the skimmer basket to remove the weight without having to reach into the debris collected in the skimmer basket so that the weight is not thrown out with the debris.

Additionally, the weight could include some type of connector or tie down, such as commercially available tie straps, so that the weight can be affixed to the skimmer basket. In one embodiment, for instance, the tie down (300) can be wrapped about the weight by placing them through the hollow opening (105) and then through the holes in the skimmer basket, as shown in FIG. 4. In this way the weight can be permanently, or removably attached to the skimmer basket.

In a further embodiment, the present invention provides an improved skimmer basket which has an embedded weight to enable the skimmer basket self-retaining at the bottom of the skimmer well without floating or tipping over when vacuum pump is off. In this embodiment, the weight (100) described above can be glued in place in the skimmer basket permanently. Alternatively, the weight can be manufactured as an integral part of the skimmer basket, to form a weight containing skimmer basket.

Figure 5:
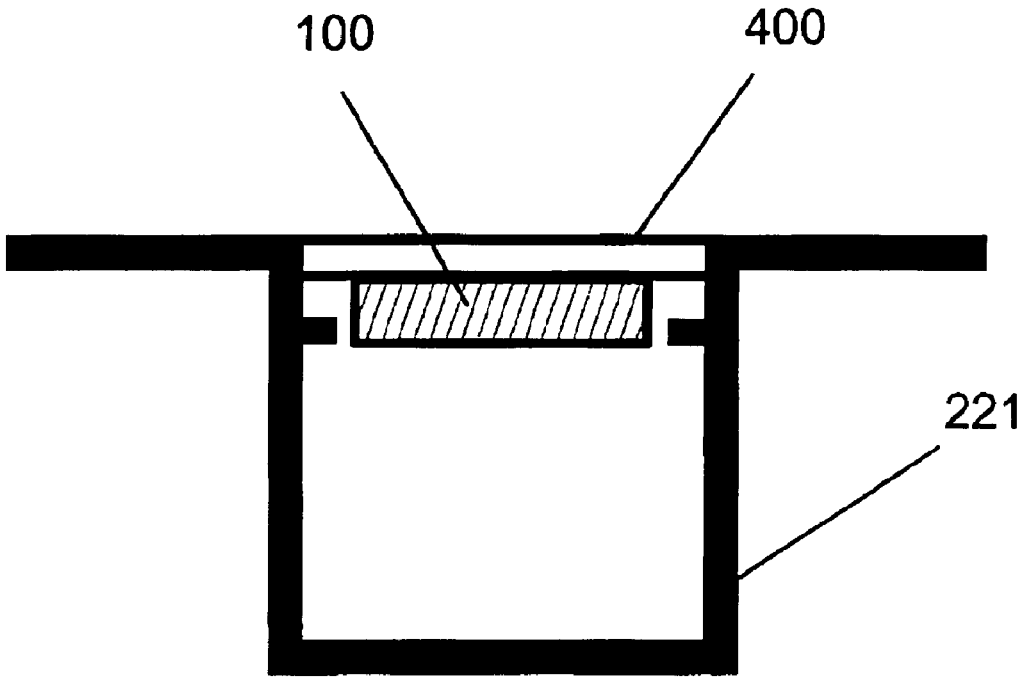
FIG. 5 is a side view of a skimmer basket weight of one embodiment of the present invention, which is affixed to the bottom of a skimmer basket.

Additionally, the weight (100) can also be used to hold down the skimmer, or main drain cover. Commercially, the main drain cover is made of plastic, usually light weight. It is common that the skimmer cover is blown out during severe storm, either falling into the pool or away from the property. It can also be easily opened and misplaced by young children. As shown in FIG. 5, the weight (100) can be attached to the bottom surface of the skimmer cover, by glue or other suitable means. Such an attachment retains the main drain cover in place under windy weather conditions, and prevents a young child to remove the cover.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

What is claimed is:

1. A skimmer basket weight comprising a heavy material having a density greater than 1.0 g/cm$^3$, covered by a water proof coating, configured to have a circular outer periphery with a hollow opening for allowing water flowing through said hollow opening, said circular outer periphery having a diameter substantially matching an inner diameter of a bottom of a skimmer basket; and wherein said skimmer basket weight has a sufficient weight to prevent said skimmer basket from floating when a pool pump is off.

2. The skimmer basket weight of claim 1, wherein said heavy material is one selected from the group consisting of metal, concrete, high density plastic, and other high density materials having a density greater than 1.0 g/cm$^3$.

3. The skimmer basket weight of claim 2, wherein said water proof coating is one selected from the group consisting of plastic, rubber, and paint.

4. The skimmer basket weight of claim 3, wherein said skimmer basket weight is greater than 0.5 pound.

5. The skimmer basket weight of claim 4, wherein said hollow opening is circular.

6. The skimmer basket weight of claim 5, wherein said hollow opening has a diameter in a range from about 90 to about 120 millimeters.

7. The skimmer basket weight of claim 6, wherein said skimmer basket weight has a height in a range from about 10 to about 50 millimeters.

8. A skimmer basket assembly comprising:

(a) a skimmer basket, (b) a skimmer basket weight comprising a heavy material having a density greater than 1.0 g/cm$^3$, covered by a water proof coating, configured to have a circular outer periphery with a hollow opening for allowing water flowing through said hollow opening, said circular outer periphery having a diameter substantially matching an inner diameter of a bottom of a skimmer basket; and wherein said skimmer basket weight has a sufficient weight to prevent said skimmer basket from floating when a pool pump is off, and (c) a fastening means enabling affixing said skimmer basket weight to said bottom of said skimmer basket.

9. The skimmer basket weight of claim 8, wherein said heavy material is one selected from the group consisting of metal, concrete, high density plastic, and other high density materials having a density greater than 1.0 g/cm$^3$.

10. The skimmer basket weight of claim 9, wherein said skimmer basket weight is greater than 0.5 pound.

11. The skimmer basket weight of claim 10, wherein said hollow opening has a diameter in a range from 90 to 120 millimeters.

12. A weight containing skimmer basket comprising a basket configured for a swimming pool skimmer well and a weight connected to a bottom of said basket, said weight comprising a heavy material having a density greater than 1.0 g/cm$^3$, covered by a water proof coating, configured to have a circular outer periphery with a hollow opening for allowing water flowing through said hollow opening, said circular outer periphery having a diameter substantially matching an inner diameter of a bottom of a skimmer basket; and wherein said skimmer basket weight has a sufficient weight to prevent said skimmer basket from floating when a pool pump is off.

13. The weight containing skimmer basket of claim 12, wherein said heavy material is one selected from the group consisting of metal, concrete, high density plastic, and other high density materials having a density greater than 1.0 g/cm$^3$.

14. The weight containing skimmer basket of claim 13, wherein said skimmer basket is greater than 0.5 pound.

15. A method of preventing a skimmer basket from floating comprising the steps of:

(a) providing a skimmer basket weight, said skimmer basket weight comprising a heavy material having a density greater than 1.0 g/cm$^3$, covered by a water proof coating, being configured to have a circular outer periphery with a hollow opening for allowing water flowing through said hollow opening, said circular outer periphery having a diameter substantially matching an inner diameter of a bottom of a skimmer basket; and said skimmer basket weight having a sufficient weight to prevent said skimmer basket from floating when a pool pump is off, and (b) placing said skimmer basket weight inside said skimmer basket and having said skimmer basket weight placed at a bottom of said skimmer basket.

16. The method of preventing a skimmer basket from floating of claim 15 further comprising affixing said skimmer basket weight to said skimmer basket.

17. The method of preventing skimmer basket floating of claim 16, wherein said skimmer basket weight is affixed to said bottom of said skimmer basket by tie straps.

* * * * *